United States Patent [19]

Chambers et al.

[11] 4,444,380

[45] Apr. 24, 1984

[54] CENTERING AND GRASPING DEVICE

[75] Inventors: Edwin G. Chambers; Albert J. Kraus, both of Columbus, Ohio

[73] Assignee: The Babcock & Wilcox Company, New Orleans, La.

[21] Appl. No.: 292,555

[22] Filed: Aug. 13, 1981

[51] Int. Cl.[3] ..... B25B 1/02

[52] U.S. Cl. ..... 269/87; 269/141; 269/208; 269/218; 269/229; 83/386

[58] Field of Search ..... 269/34, 141, 218, 208, 269/232, 172, 101, 319, 87, 99, 156, 26, 229, 233, 235, 210; 83/385, 386, 387

[56] References Cited

U.S. PATENT DOCUMENTS

| | | | |
|---|---|---|---|
| 1,005,768 | 10/1911 | Brotherhood | 269/218 X |
| 3,000,273 | 9/1961 | Witzig et al. | 269/218 X |
| 3,239,210 | 3/1966 | Hustead | 269/208 |
| 3,400,838 | 9/1968 | Leis et al. | 83/385 X |
| 3,828,398 | 8/1974 | Harris et al. | 269/26 X |

FOREIGN PATENT DOCUMENTS

| | | | |
|---|---|---|---|
| 184754 | 5/1907 | Fed. Rep. of Germany | 83/385 |
| 730728 | 5/1955 | United Kingdom | 269/34 |

*Primary Examiner*—Frederick R. Schmidt
*Assistant Examiner*—Steven P. Schad
*Attorney, Agent, or Firm*—Vytas R. Matas; Robert J. Edwards

[57] ABSTRACT

A device (10) for centering and guiding strip material (12) into a punch press (16) which device (10) is adjustable to accept different widths of strip material (12) and which grasps the strip material (12) during the punching operation. The device (10) includes a pair of parallel guide members (24, 26) mounted to a pair of slide members (28, 30) which are coupled to move in opposite directions. The slide members (28, 30) are adjustable to vary the space between the guide members (24, 26) and are actuated by an actuating rod on the press (16) to close down the space between the guide members (24, 26) when the press (16) is down during the punching operation to grasp the strip material (12) between the guide members (24, 26).

4 Claims, 4 Drawing Figures

CENTERING AND GRASPING DEVICE

TECHNICAL FIELD

The present invention relates generally to punch press guiding devices for guiding strip material thereto and particularly to such devices which are adjustable for width and grasp the strip material during the punching operation.

BACKGROUND ART

Adjustable width guiding devices for guiding different width strip material into a punch press are known in the art. Usually such devices are a pair of parallel guide plates coupled together by coupling legs to form a parallelogram. Thus as the space between the guide plates is diminished the ends of the oppositely-mounted guide plates are further separated laterally. This requires spacing the guide members away from the die of the punch press as well as any feeder mechanism feeding the guide members to allow for this lateral movement of the guide members. This makes for a laterally extended assembly which is costly and space consuming. Further, the necessary gaps between the guiding device and the die as well as the feeder mechanism become potential sources of alignment error and buckling of the strip material. Thus what was needed was a compact guiding mechanism which was still adjustable for different widths of strip material and which also would firmly grasp the strip material during the punching operation.

SUMMARY OF THE INVENTION

The present invention solves the problems of the prior art devices as well as others by providing a strip material guide for a punch press die which has a pair of parallel mounted slide members mounted to the punch press and a pair of parallel guide members respectively mounted to the pair of slide members. The guide members are used to locate the strip material and to center and guide the strip material to the die of the punch press as well as to grasp the strip material during the punching operation. To accomplish this, the pair of slide members are coupled by a mechanism which moves the slide members in opposite directions in response to movement of either slide member. Thus, the space between the parallel guide members can be varied by moving one of the slide members.

To accomplish the grasping operation, one of the slide members is formed so as to have a roller member mounted at one end of the slide member which roller member is engageable with an actuating rod mounted to the top of the punch press. During the punching operation the top of the punch press comes down, closing the progressive die and engaging the actuating rod with the roller to move the slide member. The movement of the slide member through the coupling means causes the parallel guide members mounted to the slide members to close together and to thereby grasp the sheet material between the guide members during the punching operation. An adjustable screw is mounted on the other side of the slide member having the roller member which screw is made adjustable and acts as a stop limiting the movement of the slide member to provide an adjustment on the grasping force that the parallel guide members can exert on the strip material.

In view of the foregoing, it will be seen that one aspect of the present invention is to provide a strip material guiding device for a punch press which is adjustable to allow a series of different width strip materials to be guided therebetween.

Another aspect of the present invention is to provide a device for guiding strip material with respect to a punch press which device is able to firmly grasp the strip material during the punching operation of the press.

Yet another aspect of the present invention is to provide a guiding device for guiding strip material into a punch press which has an adjustable grasping device to vary the force exerted on the strip material.

Yet one more aspect of the present invention is to provide a device for guiding strip material between a pair of guide members which guide members are made to move towards each other along a straight line.

These and other objects of the present invention will be more clearly understood after a review of the following detailed description of the preferred embodiment considered in conjunction with the accompanying drawings.

DESCRIPTION OF THE PREFERRED EMBODIMENT

Figure 1:
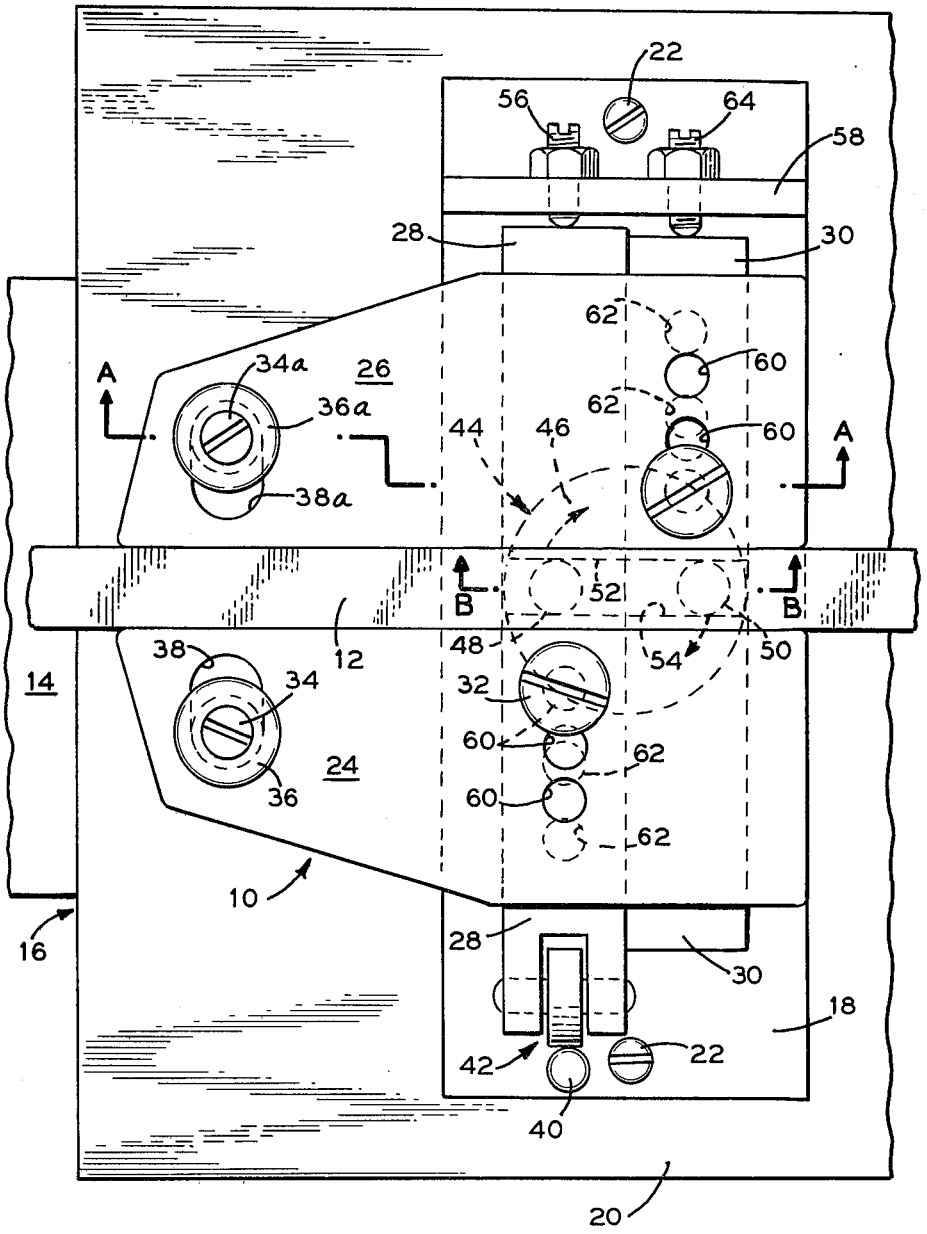
FIG. 1 is a top view of the guiding device of the present invention.
Figure 2:
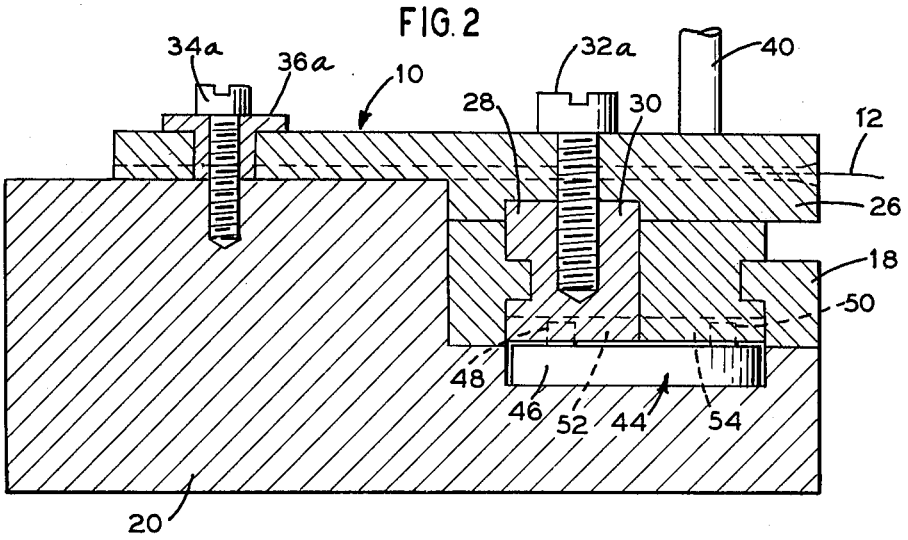
FIG. 2 is a side cross-sectional view of the FIG. 1 device taken along section A—A.
Figure 3:
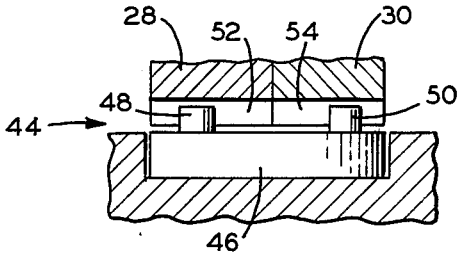
FIG. 3 is an expanded cross-sectional view of the coupling mechanism of the FIG. 1 device taken along section B—B.
Figure 4:
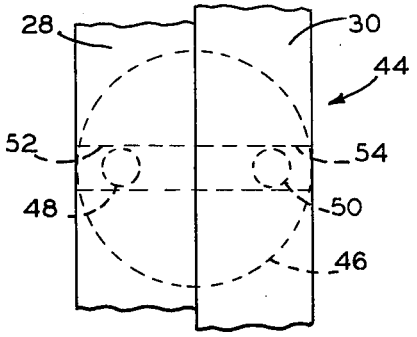
FIG. 4 is an expanded top view of the FIG. 3 coupling mechanism.

Referring now to the drawings wherein the showings are for purposes of illustrating a preferred embodiment of the present invention and are not intended to limit the invention thereto, FIGS. 1 and 2 show a guiding assembly 10 for guiding a strip of Stainless Steel material 12 from a feeder mechanism (not shown) to progressive die area 14 of a punch press assembly 16.

The guiding assembly 10 is used to center the strip material 12 with respect to the die area 14 and to grasp the strip material 12 during the punching operation of the punch press assembly 16.

The guiding assembly 10 is firstly mounted to a base 18 which is affixed to a bed 20 of the punch press assembly 16 by a pair of bolts 22. By way of the bolts 22, the guiding assembly 10 may be positioned with respect to the die area 14 of the punch press assembly 16 to properly center the strip material 12 guided by the guiding assembly 10 with respect to the die area 14.

The guiding assembly 10 is comprised of a first guide member 24 parallel-mounted to a second guide member 26 which is spaced from the first guide member 24 to allow the strip material 12 to be guided therebetween. The first guide member 24 is mounted to a first slide member 28 by way of a bolt 32 which extends through the first guide member 24 and into the first slide member 28. The other end of the first guide member 24 is affixed to the bed 20 of the punch press assembly 16 by way of a bolt 34. A spacer washer 36 is mounted between the bolt 34 and the first guide member 24 to allow the first guide member 24 to be retained to the bed 20 while allowing it to move with the first slide member 28 to the extent permitted by an oval slot 38 through which the first guide member is mounted to the bed 20. Thus, it will be seen that the first guide member is able to move in a straight line towards the second guide member 26 in response to any movement of the first slide member 28. As will be discussed later, this first slide member movement is initiated by having an actuating rod 40 which is mounted to the movable top part (not shown) of the punch press assembly 16 to engage a roller assembly 42 whenever the top of the punch press is moved down to initiate the punching operation. Thus, when the actuating rod 40 engages the roller assembly 42, it forces the first slide member 28 to move towards the second guide member 26 thus moving the first guide member 24 mounted thereto to also move towards the second guide member 26.

The second guide member 26 is similarly mounted to the bed 20 by a bolt 34*a* which extends through a spacer washer 36*a* and through an oval slot 38*a*. The second guide member 26 is mounted at the other end to the second slide member 30 by way of a bolt 32*a* to allow the second guide member 26 to be movable with the second slide member 30. Since the first slide member 28 is parallel-mounted to the second slide member 30, it will be seen that any movement of the first guide member 24 with respect to the second guide member 26 will be along a straight line.

The first slide member 28 is coupled to the second slide member 30 by a coupling assembly 44 which insures that the first slide member 28 will move in a direction opposite to the slide member 30 in response to any movement of either slide member 28 or 30. To accomplish this, the coupling assembly 44 is comprised of a circular plate member 46 which is rotatably mounted in the bed 20 and which has a pair of pins 48 and 50 extending into slots 52 and 54 formed in slide members 28 and 30. In operation, when slide member 28 is moved in either direction, the pin 48 which is captured in the slot 52 is forced to move with the slide member 28 since its movement is confined by the slot 52, the pin 48 moves laterally in the slot 52 and causes a rotation of the plate member 46. Rotation of the plate member 46 forces the pin 50 connected to the opposite end of the plate member 46 to similarly move within its confining slot 54 forcing the second slide member 30 to move with the slide member 28 but in a direction opposite the slide member 28. It will be understood that, similarly, a movement of the second slide member 30 will cause a movement of the first slide member 28 in a direction opposite to that of the second slide member 30.

It will now be seen that the guiding assembly 10 is thus able to firmly grasp the strip material 12 between the first and second guide members 24 and 26 during the punching operation of the press. As was mentioned earlier, as the press comes down to initiate the punching operation, the actuating rod 40 engages the roller assembly 42, causing the first slide member to move towards the second guide member 26. Since this movement of the first slide member 28 causes an opposite direction movement of the second slide member 30, it will be thus seen that the second slide member 26 is simultaneously made to move towards the first slide member 24. This causes the strip material 12 to be trapped between the first and second slide members 24 and 26. To provide adjustability to the grasping pressure on the strip material 12, an adjustable screw 56 is mounted through a mounting frame 58 to act as a stop for the movement of the first slide member 28. The screw 56 can be extended either in against the slide member 28 or out from the slide member 28 to provide variable motion of the slide member 28 in response to movement by the actuating rod 40. It will be understood that the actuating rod 40 has a spring release device (not shown) located thereon to take up whatever motion of the slide member 28 is limited by the screw 56.

The guiding assembly 10 is also made adjustable to accommodate varying widths of strip material 12. Usually, the strip material 12 used for the manufacture of insulation of nuclear reactors comes in three specific widths. To provide for an easy width adjustment to accommodate these three standard widths, three mounting holes 60 are predeterminedly formed on the first and second guiding members 24 and 26 which are individually alignable with mounting holes 62 formed in the first and second slide members 28 and 30. With particular reference to FIG. 1, it may be seen that the holes 60 and 62, closest to the strip material 12, are shown aligned and locked together by the bolts 32 and 32*a*. Thus, the guide assembly 10 is adjusted for the narrowest standard width of strip material 12. To change this width adjustment to the middle width strip material 12, the bolts 32 and 32*a* are removed and the middle holes 60 and 62 are aligned on the guide members 24 and 26 and the slide members 28 and 30. The bolts 32 and 32*a* are then mounted through the middle holes 60 and 62 to provide this width adjustment. Similarly, the maximum width adjustment is provided by aligning the holes 60 and 62 furtherst from the strip material 12 to allow the guiding assembly 10 to be further adjusted for non-standard widths and adjusting screw 64 maybe provided to operate in a known manner.

In view of the foregoing, it will be seen that the present invention provides a guiding assembly which is compact due to its unique movement of the guiding members towards each other which is easily adjusted to accommodate varying widths of strip material therebetween which is able to firmly grasp the strip material during the punching operation and which is easily centered with respect to the die of the press.

Certain modifications and improvements will occur to those skilled in the art upon reading this Specification. It will be understood that all such improvements and modifications have been deleted herein for the sake of conciseness and readability but are intended to be within the scope of the following claims.

We claim:

1. A device for guiding strip material with respect to the die of a punch press comprising:

a first slide member movably mounted to the punch press;

a second slide member proximately located to said first slide member and being movably mounted to the punch press;

a pair of parallel guide members for locating the strip material therebetween having a first and second guide member respectively mounted to said first and second slide members to move with said slide members;

coupling means for coupling said first and second slide members to have said first slide member move in a direction opposite said second slide member in response to movement of either slide member;

grasping means for moving said pair of parallel guide members together to hold the strip material therebetween whenever the punch press is performing the punching operation including a roller member mounted to one of said slide members and an actuating rod mounted to the press proximate said roller member to engage said roller member whenever the punch die press is closed to thereby move said slide member to close the space between said pair of parallel guide members; and adjustable stop means for limiting the movement of said grasping means including an adjustable screw mounted at the opposite end of said slide member having said roller member to limit the movement of said slide member whenever said roller member is engaged by said actuating rod.

2. A device as set forth in claim 1 wherein said first and second slide members have slots extending across the face thereof.

3. A device as set forth in claim 2 wherein said coupling means includes a rotatable circular plate mounted to the press and having a pair of posts extending therefrom into the slots of said first and second slide members.

4. A device for guiding strip material with respect to the dye of a punch press comprising;

a first slide member movably mounted to the punch press;

a second slide member approximately located to set first slide member and being movably mounted to the punch press;

a pair of parallel guide members for locating the strip material there between having a first and second guide member respectively mounted to said first and second slide members to move with said slide members;

coupling means for coupling said first and second slide members to have said first slide member move in a direction opposite said second slide member in response to movement of either slide member; and adjusting means for varying the space between said pair of parallel guide members to accommodate varying widths of strip material including a series of holes in said first guide member and a series of holes in said first slide member and a screw for fastening said first guide member to said first slide member by extending such screw through aligned holes in said first guide member and said first slide member and including a first variable stop member mounted against said first slide member to retain said first slide member in a series of positions providing a variable grasping pressure to the strip material between said pair of parallel guide members.

* * * * *